US009341090B2

(12) United States Patent
Last et al.

(10) Patent No.: US 9,341,090 B2
(45) Date of Patent: May 17, 2016

(54) OSCILLATING-MOTOR CAMSHAFT ADJUSTER HAVING A HYDRAULIC VALVE

(71) Applicant: HILITE GERMANY GMBH, Marktheidenfeld (DE)

(72) Inventors: Bernd Last, Reutlingen (DE); Gordon Neudörfer, Mähringen (DE); Udo Diederichs, Nürtingen (DE); Matthew Bradfield, Whitehall, MI (US); Melissa Mei Koenig, Ann Arbor, MI (US); Kenneth J. Parker, Clarkston, MI (US)

(73) Assignee: HILITE GERMANY GMBH, Marktheidenfeld (DE)

( * ) Notice: Subject to any disclaimer, the term of this patent is extended or adjusted under 35 U.S.C. 154(b) by 0 days.

(21) Appl. No.: 14/174,594

(22) Filed: Feb. 6, 2014

(65) Prior Publication Data

US 2015/0218976 A1 Aug. 6, 2015

(51) Int. Cl.
*F01L 1/34* (2006.01)
*F01L 1/344* (2006.01)

(52) U.S. Cl.
CPC ..... *F01L 1/3442* (2013.01); *F01L 2001/34426* (2013.01)

(58) Field of Classification Search
CPC ..... F01L 1/3442; F01L 2001/34426
USPC ..... 123/90.15, 90.17, 90.12
See application file for complete search history.

(56) References Cited

U.S. PATENT DOCUMENTS

| | | | | |
|---|---|---|---|---|
| 7,681,542 | B2 * | 3/2010 | Paul et al. | 123/90.17 |
| 7,836,857 | B2 * | 11/2010 | Knecht et al. | 123/90.12 |
| 7,946,266 | B2 * | 5/2011 | Knecht et al. | 123/90.17 |
| 8,534,242 | B2 * | 9/2013 | Busse | F01L 1/3442 123/90.12 |
| 8,662,040 | B2 * | 3/2014 | Knecht et al. | 123/90.17 |
| 2009/0071140 | A1 | 3/2009 | Knecht et al. | |
| 2009/0071426 | A1 | 3/2009 | Knecht et al. | |
| 2009/0159024 | A1 * | 6/2009 | Paul et al. | |
| 2010/0037841 | A1 | 2/2010 | Strauss et al. | |
| 2010/0326385 | A1 * | 12/2010 | Busse | |
| 2011/0139100 | A1 | 6/2011 | Busse et al. | |
| 2011/0247576 | A1 * | 10/2011 | Knecht et al. | |

FOREIGN PATENT DOCUMENTS

| | | |
|---|---|---|
| DE | 10 2006 012 733 | 9/2007 |
| DE | 10 2006 012 775 | 9/2007 |
| DE | 10 2008 055 175 | 7/2009 |
| DE | 10 2010 013 777 | 10/2011 |
| DE | 10 2010 022 896 | 12/2011 |
| EP | 1 371 818 | 12/2003 |
| WO | 2008/067935 | 6/2008 |

* cited by examiner

*Primary Examiner* — Ching Chang
(74) *Attorney, Agent, or Firm* — Clark Hill PLC; James R. Foley

(57) ABSTRACT

An oscillating-motor camshaft adjuster which provides that, through software, camshaft alternating torque is utilized only in conditions where the torque is adequate and/or it is important to reduce flow consumption. If there is two step lift and the camshaft alternating torque is not adequate in low lift, software can position the spool to utilize some camshaft alternating torque while also tanking oil to speed up the phasing.

13 Claims, 9 Drawing Sheets

OSCILLATING-MOTOR CAMSHAFT ADJUSTER HAVING A HYDRAULIC VALVE

BACKGROUND

The invention relates to an oscillating-motor camshaft adjuster having a hydraulic valve that has two working ports.

DE 10 2006 012 733 B4 and DE 10 2006 012 775 B4 relate to an oscillating-motor camshaft adjuster having a hydraulic valve that has two working ports. These two working ports each have a standard opening axially adjacent to one another and an opening for the utilization of pressure peaks as a consequence of camshaft alternating torques. In this case, in order to adjust the camshaft, a hydraulic pressure can be introduced from a supply port to the working port that is to be loaded, whereas the working port that is to be relieved of pressure is guided to a tank port. The hydraulic valve is designed as a multiple port, multiple position valve in cartridge construction. Non-return valves, which are designed as band-shape, rings, are inserted on the inside of the carriage or central bolt. By means of these non-return valves, camshaft alternating torques are utilized in order to assist camshaft adjustment more rapidly and with a relatively low oil pressure. For this purpose, non-return valves open to utilize pressure peaks as a consequence of camshaft alternating torques and cover the openings to prevent back flow into the relieved port.

SUMMARY

An object of an embodiment of the present invention is to provide an oscillating-motor camshaft adjuster that is controlled in a simple manner that allows tuning by electronic control means.

Briefly, an embodiment of the present invention provides an oscillating-motor camshaft adjuster which provides that, through software, camshaft alternating torque is utilized only in conditions where the torque is adequate and/or it is important to reduce flow consumption. If there is two step lift and the camshaft alternating torque is not adequate in low lift, software can position the spool to utilize some camshaft alternating torque while also tanking oil to speed up the phasing.

Additional advantages of the invention may be derived from the description and the drawings.

BRIEF DESCRIPTION OF THE DRAWINGS

The present invention will hereinafter be described in conjunction with the appended drawing figures, wherein like reference numerals denote like elements.

DETAILED DESCRIPTION OF AN ILLUSTRATED EMBODIMENT

The ensuing detailed description provides exemplary embodiments only, and is not intended to limit the scope, applicability, or configuration of the invention. Rather, the ensuing detailed description of the exemplary embodiments will provide those skilled in the art with an enabling description for implementing an embodiment of the invention. It should be understood that various changes may be made in the function and arrangement of elements without departing from the spirit and scope of the invention as set forth in the appended claims.

Figure 1:
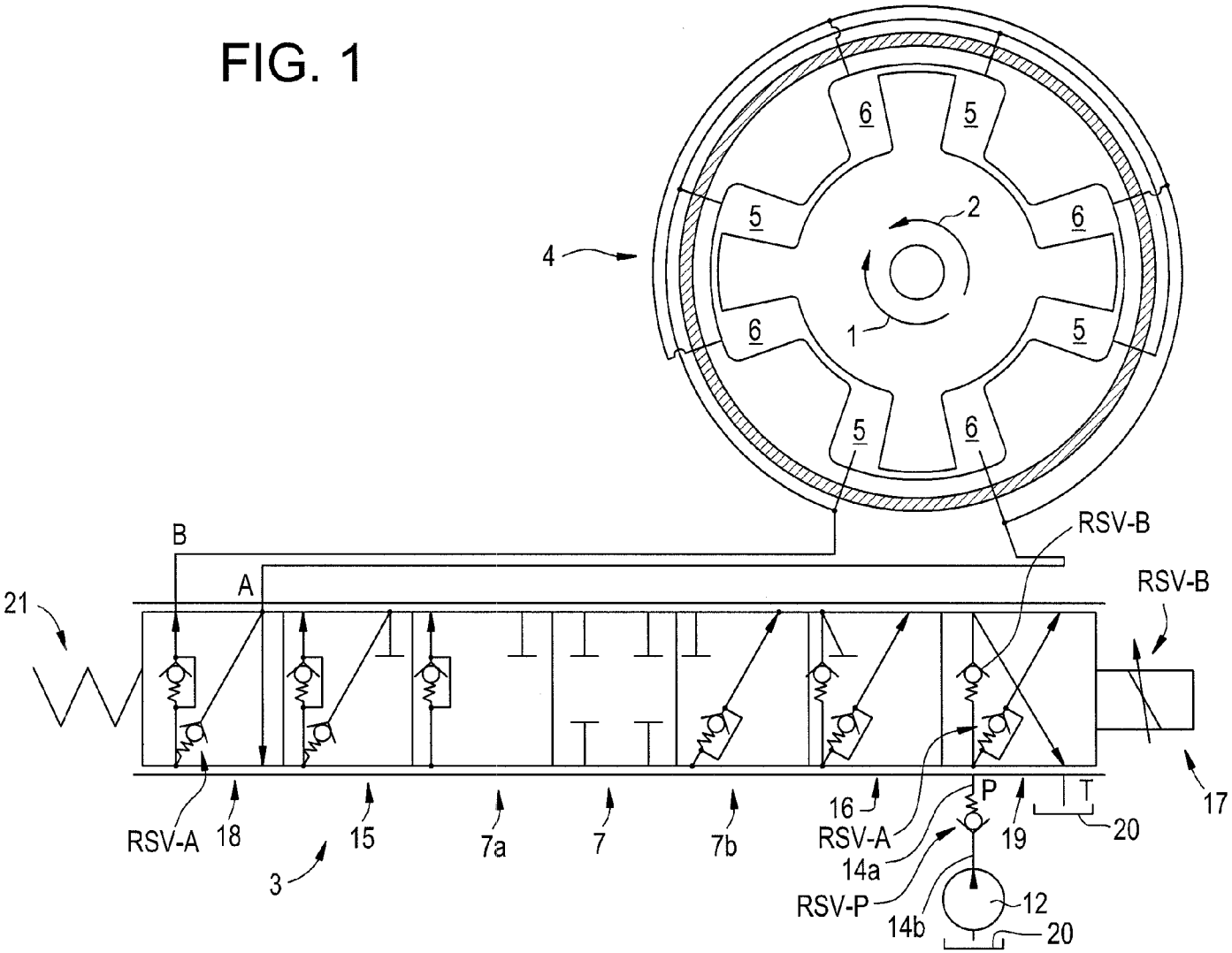
FIG. 1 shows an example embodiment of a circuit diagram of a proportionally controllable hydraulic valve that can be actuated in five main positions.

FIG. 1, in a circuit diagram, shows a hydraulic valve 3 in accordance with an example embodiment of the present invention, which can be actuated by means of an electromagnet 17 against a spring force of a spring 21 and which is controlled proportionally. An oscillating-motor camshaft adjuster 4 can be pivoted by this hydraulic valve 3. The angular position between the crankshaft and the camshaft can be changed with such an oscillating-motor camshaft adjuster 4 during the operation of an internal combustion engine. By rotating the camshaft, the opening and closing time points of the gas exchange valves are shifted so that the internal combustion engine offers its optimal performance at the load and speed involved. The oscillating-motor camshaft adjuster 4 thus makes possible a continual adjustment of the camshaft relative to the crankshaft.

A first working port A and a second working port B exit from hydraulic valve 3 to oscillating motor camshaft adjuster 4. Hydraulic valve 3 has four ports and five main functional positions and can thus be designated also as a 4/5-way valve with a blocking center position 7. The valve technically has seven states but positions 7, 7*a* and 7*b* are used for holding the relative position of the rotor to the stator with positions 7*a* and 7*b* allowing oil into ports B and A, respectively, as required to compensate for system leakage. Although the oil routing changes in functional position, the flow opening of the valve is variable by incremental position within a functional state.

In order to pivot the oscillating-motor camshaft adjuster 4 into the first direction of rotation 1, hydraulic valve 3 is found in one of the two positions 16 or 19, which are shown by the two boxes to the right of the center blocking position 7. In FIG. 1 of the drawings, the hydraulic valve 3 is moved to position 19 when the hydraulic valve 3 is fully stroked by the actuator. In this way, pressure chambers 6 assigned to this direction of rotation 1 are loaded from the first working port A with pressure (that comes from the supply port P).

In contrast, in positions 16 or 19, pressure chambers 5 assigned to the second working port B are relieved of pressure. In position 19, the second working port B is guided to tank 20 via the tank port T for this purpose. In the intermediate positions 7*b* and 16 between the center blocking position 7 up to position 19, pressure chambers 6 are loaded from the first working port A with a pressure that comes from the supply port P, but the second working port B is blocked from tank port T.

The reverse applies analogously. That is, in order to now pivot the oscillating-motor camshaft adjuster 4 into the second direction of rotation 2, hydraulic valve 3 is found in one of the two positions 18 or 15 which are shown by the two to the left of the center blocking position 7. In FIG. 1 of the drawings, the hydraulic valve 3 is found fully extended by spring 21 in position 18 of the box. In this way, pressure chambers 5 assigned to this direction of rotation 2 are loaded from the second working port B with pressure (with a pressure that comes from supply port P).

In contrast, in positions 18 or 15, pressure chambers 6 assigned to the first working port A are relieved of pressure. In position 18, the first working port A is guided to tank 20 via the tank port T for this purpose. In the intermediate positions 15 and 7*a* between the blocking center position 7 and up to position 18, pressure chambers 5 are loaded from the second working port B with a pressure that comes from supply port P, but the first working port A is blocked from tank port T.

In the blocking center position 7, all four ports A, B, P, T are blocked. This position, as well as positions 7*a* and 7*b* (the adjacent positions), are used to hold the rotor in a constant position relative to the stator.

For this purpose, in position 7*a*, supply port P is connected to the second working port B, whereas the first working port A is blocked from the tank port T. In position 7*a*, interaction of interior land of the spool with the land of the cartridge or central valve bolt prevents the first working port A from being exposed to the supply port P. Therefore, in position 7*a*, the first working port A is prevented from being exposed to both the tank port T as well as the supply port P.

In position 7*b*, supply port P is connected to the first working port A, whereas the second working port B is blocked from the tank port T. In position 7*b*, interaction of interior land of the spool with the land of the cartridge or central valve bolt prevents the second working port B from being exposed to the supply port P. Therefore, in position 7*b*, the second working port B is prevented from being exposed to both the tank port T as well as the supply port P. Positions 7*a* and 7*b* provide the benefit of keeping the phaser full of oil with lower pump pressures. By blocking one working port from the supply port P, the supply port P can better fill the other working port.

In the two outermost positions 18 and 19 of hydraulic valve 3, the adjustment of the camshaft by loading one side of the vanes is accomplished by utilizing recirculated oil available as a result of camshaft alternating torques, in conjunction with oil introduced from supply port P. Pressure is relieved from the other side of the vanes by recirculating oil to the loading vanes and simultaneously tanking oil. For this purpose, in the outermost position 18, wherein a flow volume of hydraulic fluid coming from a non-return valve RSV-A assigned to the first working port A is made available to supply port P and B. Also in position 18, an additional A port that does not contain a non-return valve is allowed to exhaust to tank 20 via a tank port T for this purpose. In contrast, in position 19, wherein a flow volume of hydraulic fluid coming from a non-return valve RSV-B assigned to the first working port A is made available to supply port P and A. Also in position 19, an additional B port that does not contain a non-return valve is allowed to exhaust to tank 20 via a tank port T for this purpose.

Similarly, in positions 15 and 16 of hydraulic valve 3, the adjustment of the camshaft by loading one side of the vanes is accomplished by utilizing recirculated oil available as a result of camshaft alternating torques, in conjunction with oil introduced from supply port P. Different than positions 18 and 19, pressure is relieved from the other side of the vanes only by recirculating oil to the loading vanes. For this purpose, in position 15, wherein a flow volume of hydraulic fluid coming from a non-return valve RSV-A assigned to the first working port A is made available to supply port P and B. In contrast, in position 16, a flow volume of hydraulic fluid coming from a non-return valve RSV-B assigned to the second working port B is made available to supply port P and A. Positions 15 and 16 do not connect any port to tank.

In positions 15, 16, 18 and 19, this additional flow volume from working port A or B to be relieved of pressure is fed into the flow volume coming from an oil pump 12 at supply port P. The supply port P is connected via a pump non-return valve RSV-P to oil pump 12, which introduces the pressure to assist adjustment of the oscillating-motor camshaft adjuster 4. This pump non-return valve RSV-P in this case blocks the pressures in hydraulic valve 3, so that peak pressures coming from the working port A or B to be relieved of pressure can be made available to a greater fraction of the adjustment support than would be the case in an open oil pump line 14*a*, 14*b*.

FIG. 4 to FIG. 10 show example structural embodiments of hydraulic valve 3 in the seven positions 18, 15, 7*a*, 7, 7*b*, 16, 19 according to FIG. 1.

Figure 4:
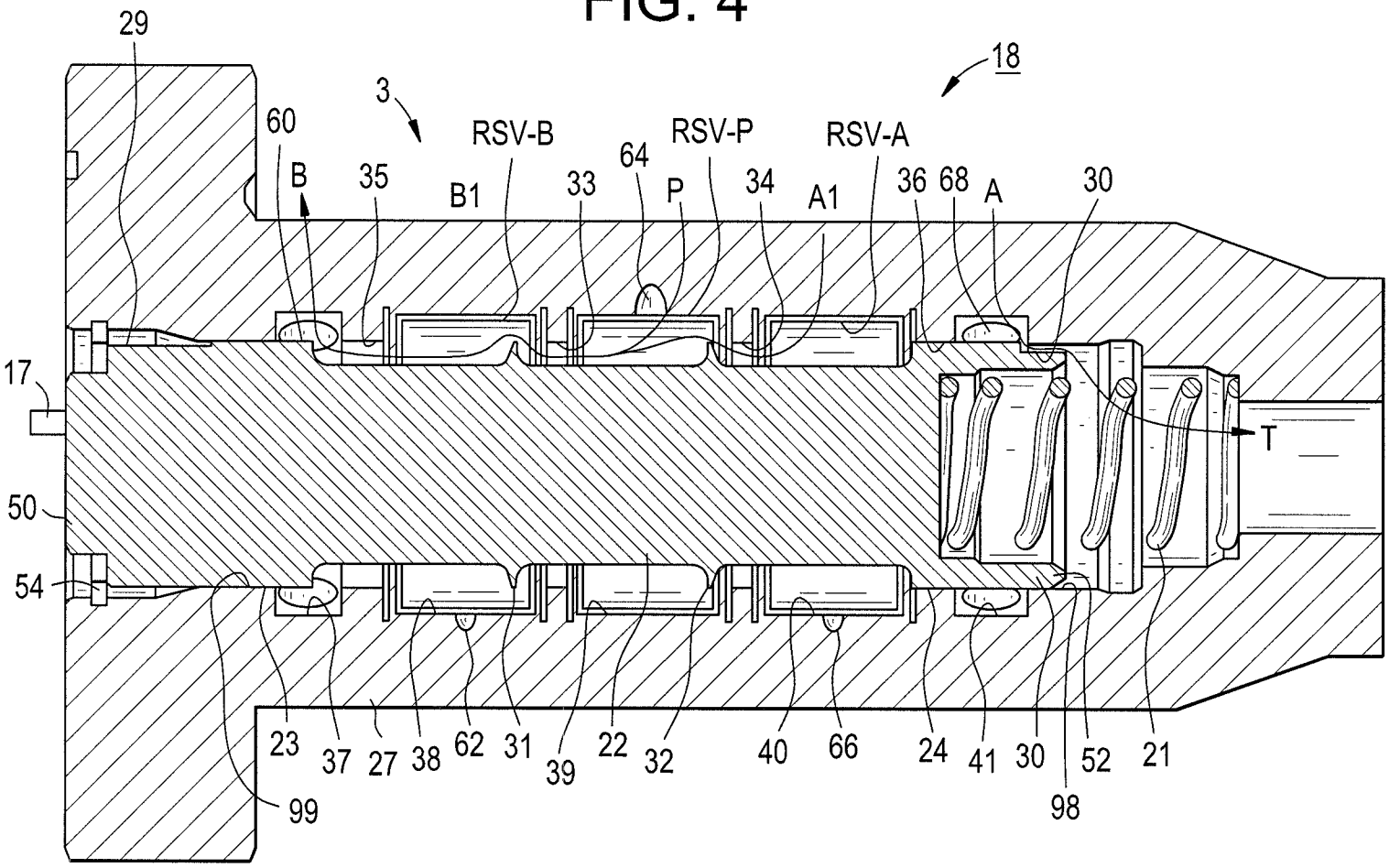
FIGS. 4-10 show an example structural implementation of the hydraulic valve according to FIG. 1, in various positions.

FIG. 4 shows the hydraulic valve 3 in the first position 18, in which electromagnet 17 according to FIG. 1 does not move a spool 22 of hydraulic valve 3. The stroke of spool 22 thus lies at zero. Spool 22 can move inside a central bolt 27 against the force of spring 21 designed as a coil-type pressure spring. The end 50 of the spool 22 facing electromagnet 17 is thus closed for producing a bearing surface for an actuating pintle of electromagnet 17, whereas the other end 52 of the spool 22 is open for receiving an end of spring 21. The spool 22 is retained in the central bolt 27 via a retaining ring 54. Spool 22 has outer lands 23, 24, on its two ends, which are guided relative to central bolt 27. The two outer lands 23, 24 have flat flow surfaces 29, 30, partially across the lands so that an access to tank port T is present along these flow surfaces 29, 30 out the ends of the central bolt 27. An alternative embodiment could very well provide that the spool 22 is hollow and axial port bores are included for flow to the tank port T.

Two narrow ribs or lands 31, 32 that run around spool 22 are provided axially between the two outer lands 23, 24. These circumferential ribs 31, 32 correspond to two annular webs 33, 34 extending from central bolt 27 radially to the inside. Two axial outer annular webs 35, 36 are also provided in addition to these two annular webs 33, 34. These four annular webs 33, 34, 35, 36 are formed, since five inner annular grooves 37, 38, 39, 40, 41 are hollowed out of the central bolt 27. Five port bores 60, 62, 64, 66, 68 which are drilled through the wall of central bolt 27 open into these five inner annular grooves 37, 38, 39, 40, 41. More than one bore per annular groove is possible depending upon flow requirements.

These five port bores 60, 62, 64, 66, 68, axially along the bolt from the electromagnet 17, form the following: a standard opening B belonging to the second working port B, an opening B1 belonging to the second working port B for utilizing the camshaft alternating torques, the supply port P, an opening A1 belonging to the first working port A for utilizing camshaft alternating torques, and A belonging to the first working port A.

Thus, in each case, two openings A, A1 or B, B1 are provided on the two working ports A, B. The axial inner openings A1, B1 for utilizing camshaft alternating torques are provided by these. In contrast to the axially outer openings A, B that can be blocked from inside exclusively by outer lands 23, 24, the axially inner openings A1, B1 have band-shaped non-return valves RSV-A, RSV-B. Each of the band-shaped non-return valves RSV-A or RSV-B is inserted in an inner annular groove 40 or 38 radially inside the axially inner openings A1 or B1 of central bolt 27. According to the method described in DE 10 2006 012 733 B4, with non-return valves RSV-A, RSV-B, it is possible to provide a hydraulic pressure in the region of the supply port P, this pressure increasing in a short time to above the level of the hydraulic pressure in the hydraulic chambers 6 or 5 to be pressure-loaded, as a consequence of camshaft alternating torques. Then, from this supply port P, these hydraulic pressure peaks or this additional hydraulic fluid flow, together with the hydraulic pressure introduced to supply port P by oil pump 12, is made available to hydraulic chambers 6 or 5 to be loaded.

In addition, the band-shaped pump non-return valve RSV-P is provided in an inner annular groove 39. This pump non-return valve RSV-P is basically constructed in the same way as the two non-return valves RSV-A, RSV-B. However, this pump non-return valve RSV-P may have another response force.

In position 18 according to FIG. 4, the two center ribs 31, 32 are axially distanced from the two annular webs 33, 34, so that hydraulic fluid can penetrate through the gap between them. Likewise, hydraulic fluid can penetrate through the gap between the frontmost outer land 23 and the corresponding annular web 35 on central bolt 27. In contrast, the other outer land 24 blocks the rearmost inner annular groove 41 or the standard opening A belonging to the first working port A. For this purpose, the outer land 24 and the rearmost annular web 36 overlap over a large sealing length.

Because of this, in this position 18, hydraulic fluid from the supply port P can reach the standard opening B belonging to the second working port B via the pump non-return valve RSV-P. The other two non-return valves RSV-A and RSV-B thus block the openings A1 and B1 against pressures from the supply port P and from the standard opening B belonging to the second working port B. In contrast, short-term peak pressures are transmitted from the opening A1 belonging to the first working port A by its non-return valve RSV-A as a consequence of the camshaft alternating torques. When the pressure relating to working port A is high due to cam torque, it is greater than the pressure P. RSV-A check valve then opens to flow oil from A while the P check valve (RSV-P) closes. In position 18, pressure from the first working port A is recirculated from A to B (via opening A1), the first working port A also vents to the tank port T (via standard opening A and flow surface 30).

Figure 5:
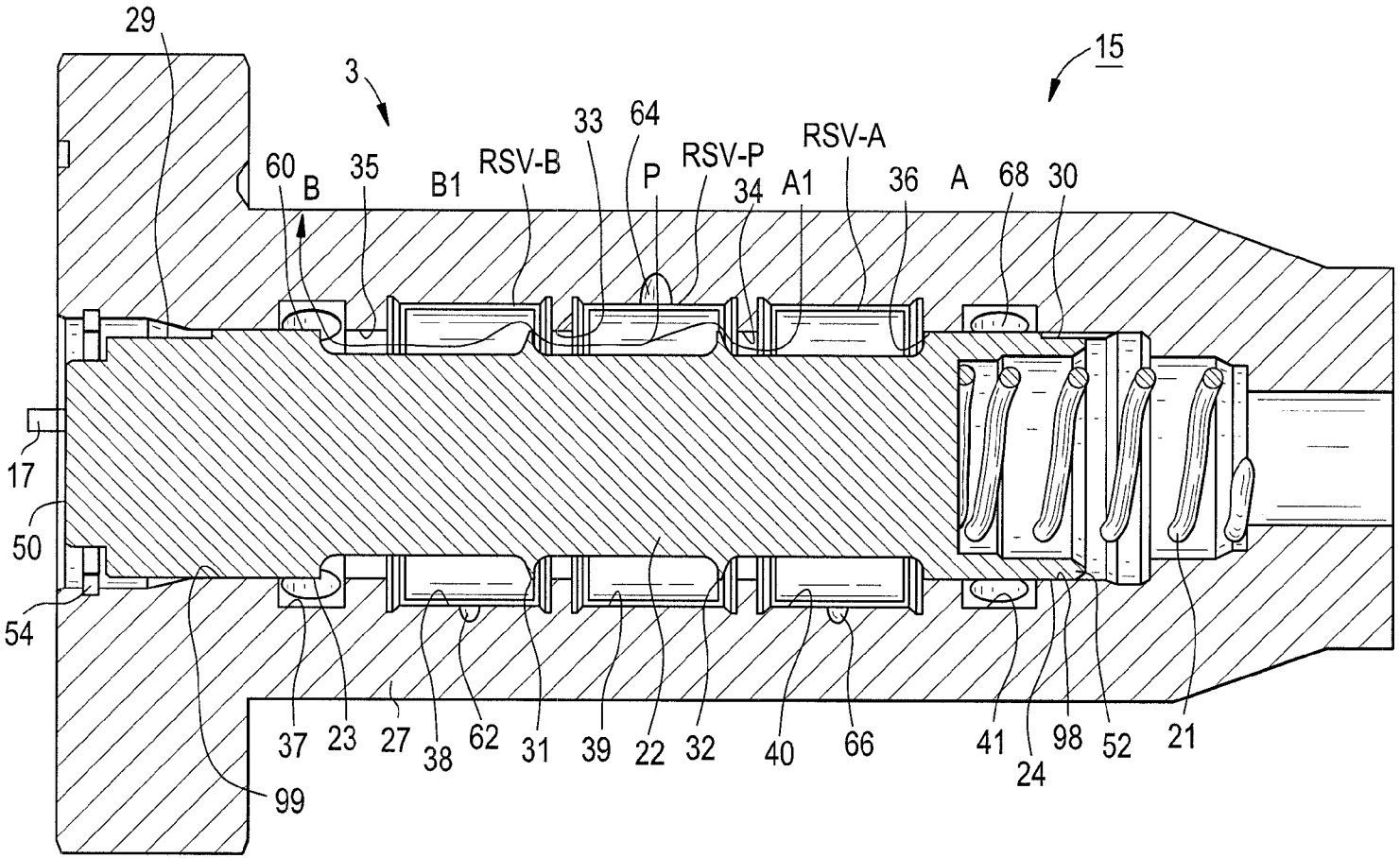

FIG. 5 shows spool 22 with a stroke of 0.4 mm. In this case, hydraulic valve 3 function is found in position 15. Position 15 is much like position 18 except that the spool 22 has been advanced to a position to where the first working port A is blocked from the tank port T via the interfacing of land 24 with bolt surface 98 which does not allow A to connect to flow surface 30.

Between position 15 shown in FIG. 5 and position 18 shown in FIG. 4, the first working port A is increasingly open to tank port T. This allows both hydraulic fluid recirculation from first working port A to second working port B and tanking of first working port A (i.e. flow of hydraulic fluid from first working port A to the tank port T).

Figure 6:
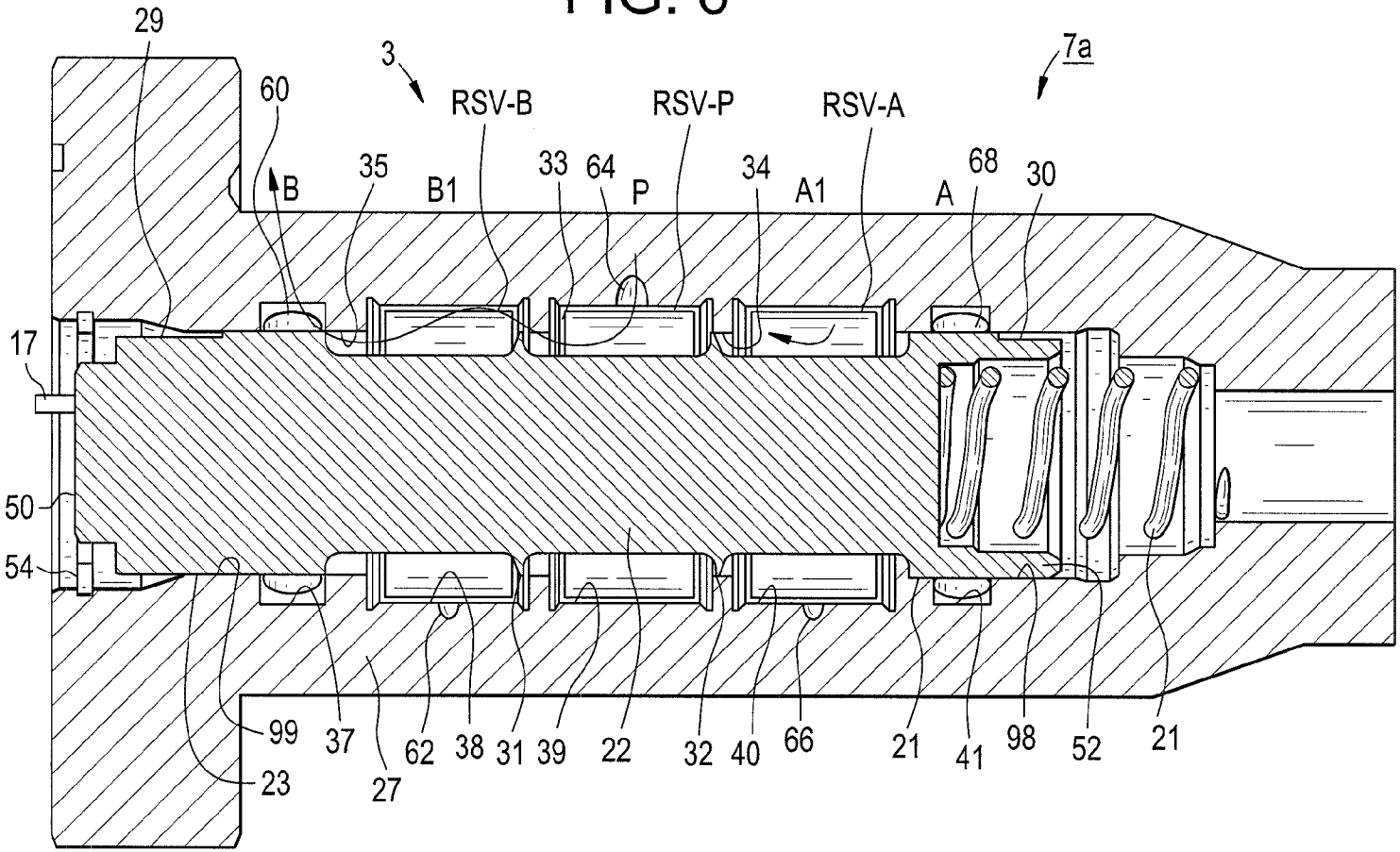

FIG. 6 shows spool 22 with a stroke of 1.1 mm. In this case, hydraulic valve 3 is found in position 7*a*. Position 7*a* is much like position 15 in that first working port A is blocked from the tank port T via the interfacing of land 24 with surface 98. However, in position 7*a*, the first working port A is also blocked from the second working port B via the interfacing of land 32 with web 34. The supply port P is connected to second working port B.

Between position 7*a* shown in FIG. 6 and position 15 shown in FIG. 5, the supply port P is increasingly allowed access to the second working port B, and hydraulic fluid flow from the first working port A is increasingly recirculated into the second working port B when cam torque pulse increases the pressure of the first working port A above the second working port B and the supply port P.

Figure 7:
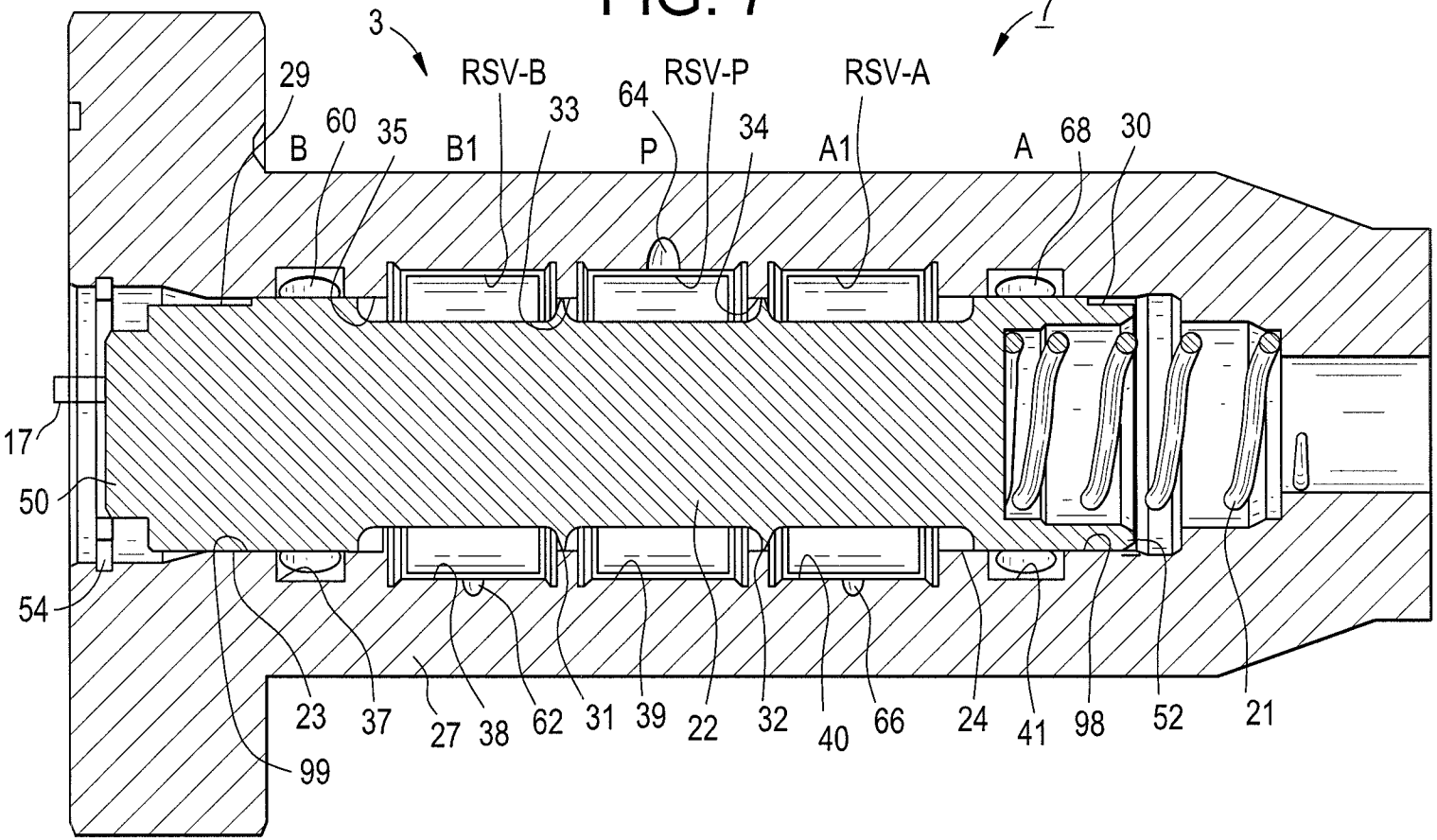

FIG. 7 shows spool 22 with a stroke of 1.7 mm. Here, hydraulic valve 3 is found in the blocking center position 7. The supply port P is closed by the two ribs 31, 32. For this purpose, ribs 31, 32 cover the corresponding annular webs 33, 34 to a correspondingly large extent. The two working ports A, B are also blocked to tank outlet T, as a result of land 24 interfacing with surface 98, and land 23 interfacing with surface 99.

Figure 8:
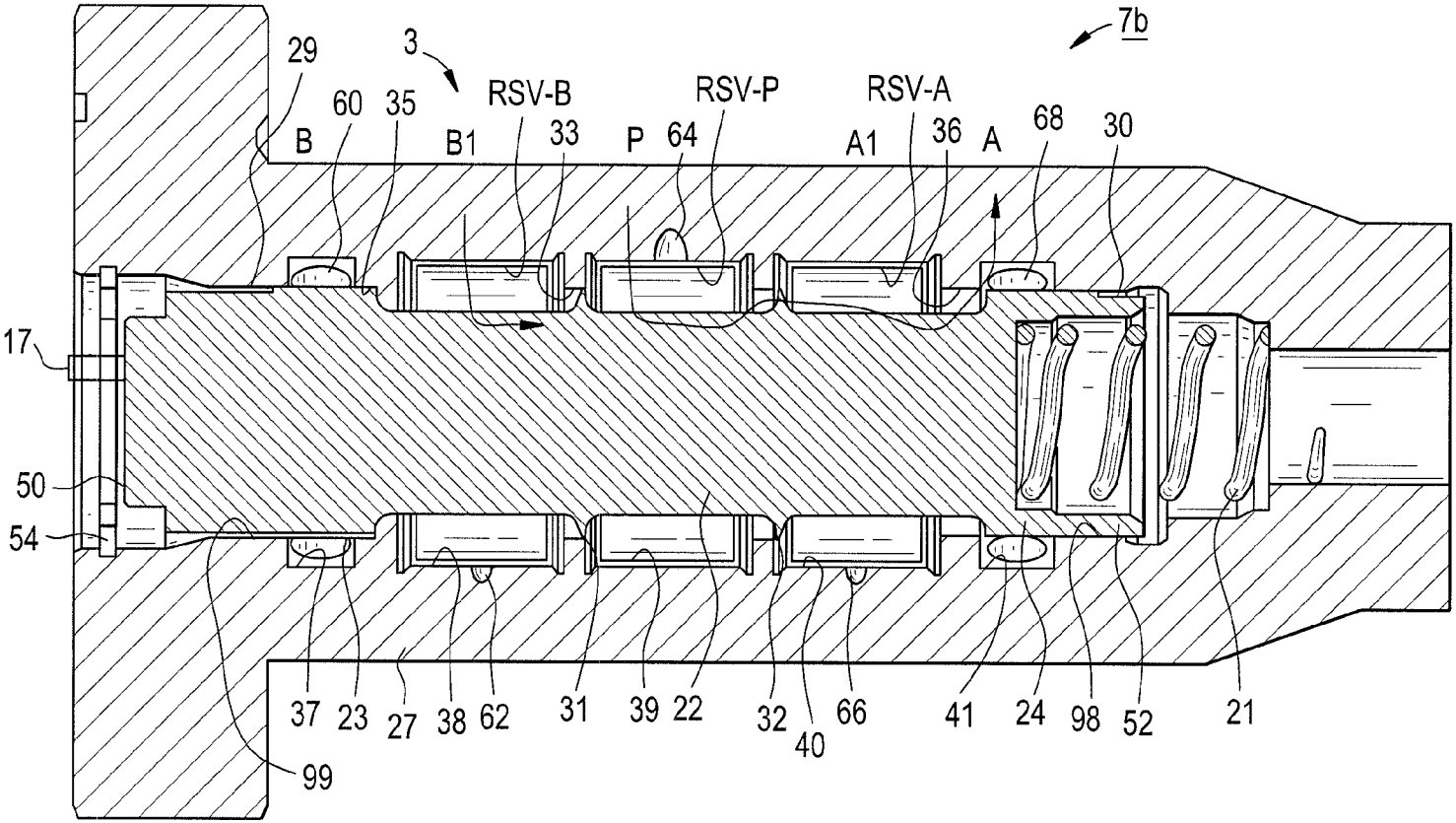

While the blocking center position 7 shown in FIG. 7 is effectively the hold position, the spool will move between this position and either position 7*a* shown in FIG. 6 or position 7*b* shown in FIG. 8 to compensate for hydraulic fluid leakage.

FIG. 8 shows spool 22 with a stroke of 2.3 mm. In this case, hydraulic valve 3 is found in position 7*b*, and second working port B is blocked from the tank port T via the interfacing of land 23 with surface 99. However, in position 7*b*, the second working port B is also blocked from the first working port A via the interfacing of land 31 with web 33. The supply port P is connected to first working port A.

Figure 9:
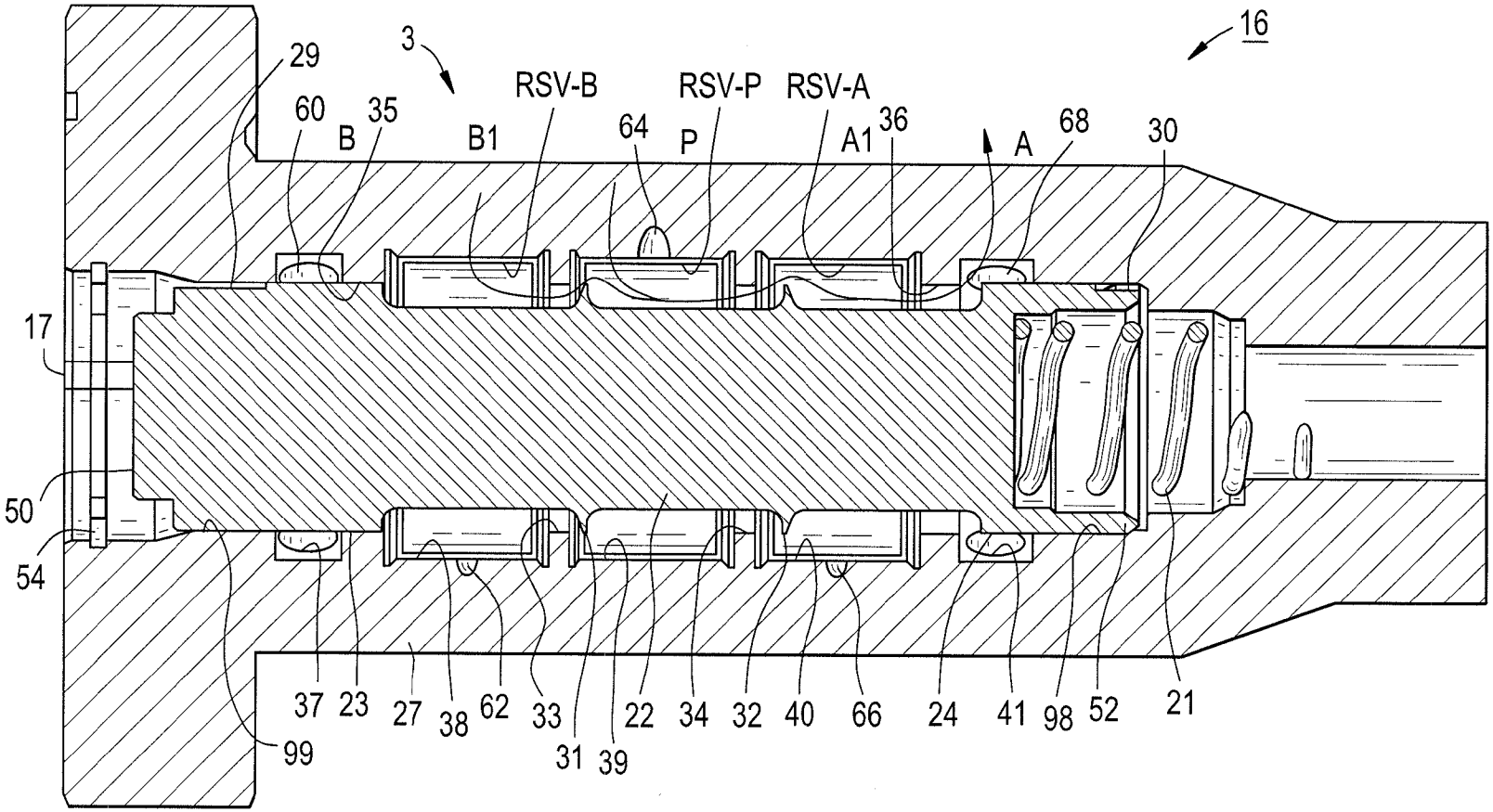

FIG. 9 shows spool 22 with a stroke of 3.0 mm. In this case, hydraulic valve 3 function is found in position 16, and the second working port B is blocked from the tank port T via the interfacing of land 23 with surface 99. Furthermore, short-term peak pressures are transmitted from the opening B1 belonging to the second working port B by its non-return valve RSV-B as a consequence of the camshaft alternating torques. In position 16, first working port A is pressurized by the supply port P, and pressure from the second working port B is recirculated from B to A (via opening B1).

Between position 7*b* shown in FIG. 8 and position 16 shown in FIG. 9, the supply port P is increasingly allowed access to the first working port A, and hydraulic fluid flow from the second working port B is increasingly recirculated into the first working port A when cam torque pulse increases the pressure of the second working port B above the first working port A and the supply port P.

Figure 10:
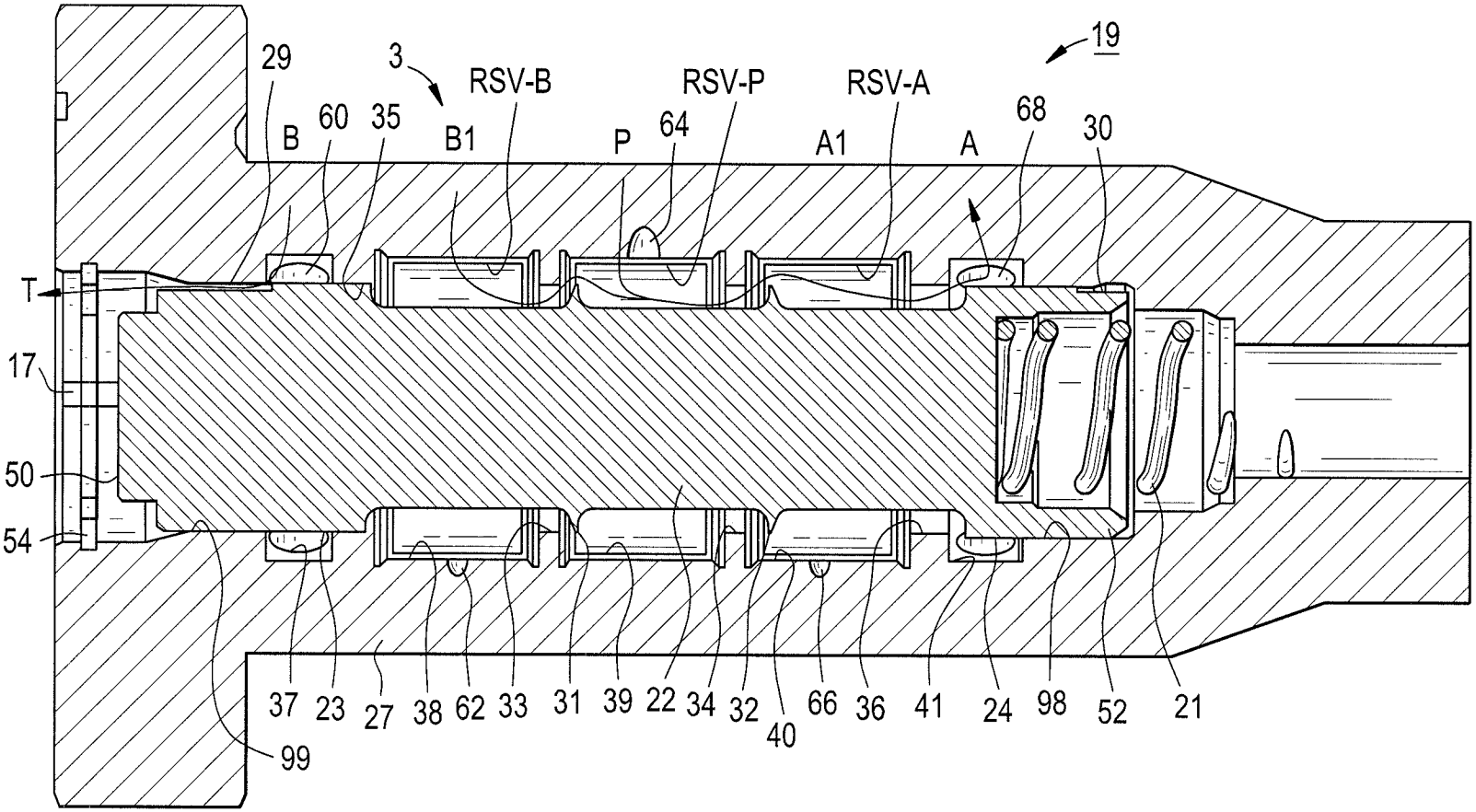

FIG. 10 shows spool 22 with a stroke of 3.4 mm. In this case, hydraulic valve 3 is found in position 19. In this position 19, the two center ribs 31, 32 are axially distanced from the two annular webs 33, 34, so that hydraulic fluid can penetrate through the gaps. Likewise, hydraulic fluid can penetrate through the gap between the rearmost outer web 24 and the corresponding annular web 36. In contrast, the other outer land 23 blocks the frontmost inner annular groove 37 or the standard opening B of the second working port B. For this purpose, the outer land 23 and the frontmost annular web 35 overlap over a large sealing length. Because of this, in this position 19, hydraulic fluid from the supply port P can reach the standard opening A of the first working port A via the pump non-return valve RSV-P. In this case, the other two non-return valves RSV-A and RSV-B block the openings A1 and B1 against pressures from the supply port P. In contrast, short-term peak pressures as a consequence of the camshaft alternating torques are transmitted from the opening B1 of the second working port B by its non-return valve RSV-B. As such, pressure from the second working port B is recirculated from B to A (via opening B1), second working port B also vents to tank port T (via standard opening B and flow surface 29).

Between position 16 shown in FIG. 9 and position 19 shown in FIG. 10, the second working port B is increasingly open to tank port T. This allows both hydraulic fluid recirculation from second working port B to first working port A and tanking of second working port B (i.e., flow of hydraulic fluid from second working port B to the tank port T).

One of the main benefits of the system described herein is that through software control of the hydraulic valve, Duty Cycle (or current) can be limited to only allow recirculation (positions 15 and 16) when there is adequate cam torque to achieve desired phase rates. It can also be limited to positions 15 and 16 if there is inadequate flow in the engine oil system and further loading is undesirable.

When cam torque is not adequate, such as in low lift mode of a two step lift system, then the software will allow use of positions 18 and 19 for phasing. High rpm's also do not allow enough time to make good use of cam torque pulses so using positions 18 and 19 can increasing phasing speeds at high rpm's if needed. The amount of flow opening to the tank port T and the valve travel positions where positions 18 and 19 start can be tailored for the application.

In the example of embodiment presented, the standard opening A or B and the opening A1 or B1 are combined in order to utilize camshaft alternating torques first outside central bolt 27 to working port A or B, respectively. In an alternative embodiment, it is also possible to combine standard opening A or B and opening A1 or B1 also inside central bolt 27 in order to utilize the camshaft alternating torques.

In another alternative embodiment, ball-type non-return valves can be used instead of band-shaped non-return valves. Thus, it is also possible, for example, to use ball-type non-return valves inside the hydraulic valve, as is demonstrated, for example, in DE 10 2007 012 967 B4. Ball-type non-return valves, in this case, however, do not absolutely need to be built into the central valve of a cartridge valve. For example, it is also possible to use ball-type non-return valves in a rotor and to design the spool as a central valve, which is disposed so that it can move coaxially and centrally inside the rotor hub.

Depending on the application conditions of the valve in each case, filters may also be provided in the direction of flow in front of one or more or even all ports, these filters protecting the contact surfaces between the spool and the central valve.

The utilization of camshaft alternating torques need not be provided for both directions of rotation. It is also possible to dispense with one of the two axially outermost positions 18 or 19. Accordingly, the camshaft alternating torques can then be used directly for more rapid adjustment only for one direction of rotation.

In an alternative embodiment, a utilization of the camshaft alternating torques can be provided also for both directions of rotation, whereby in this case, however, one of the circumventing non-return valves RSV-A, RSV-B will be omitted.

Further, any combination of positions is possible. For example, it is possible to eliminate one or more positions or states, or add one of more additional positions or states.

Another position may also be provided on the hydraulic valve, wherein self-centering mid-lock supplies a metered oil to A and B, where one side is exhausted until centered. The pin is exhausted allowing it to drop into the lock pin hole, locking the phaser in the mid-lock position. Mid-locking is presented, for example, in DE 10 2004 039 800 and DE 10 2009 022 869.1-13.

Figure 2:
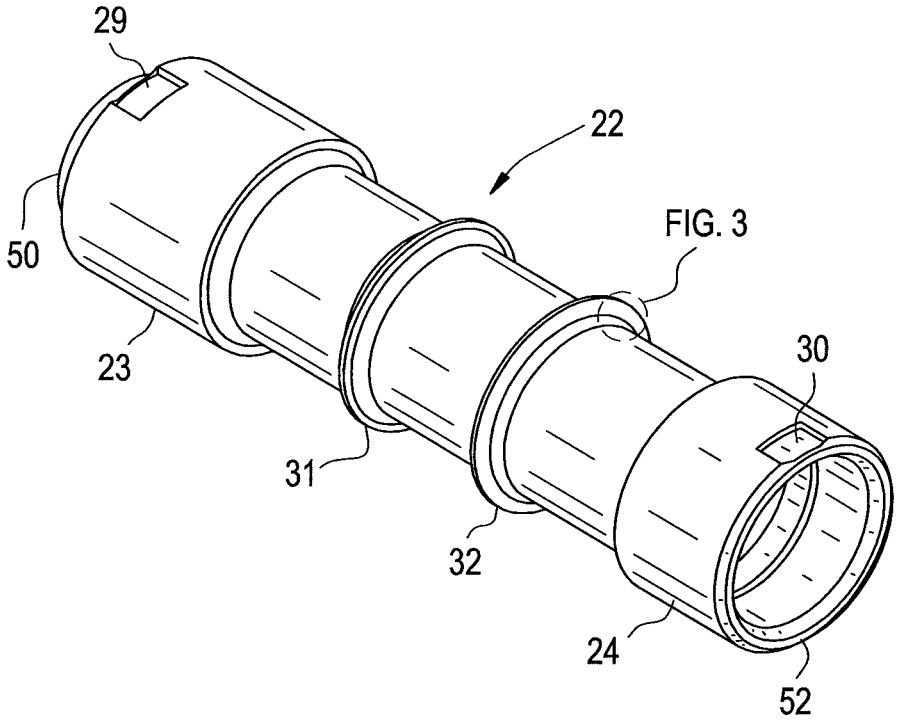
FIG. 2 shows a perspective view of a spool component of the hydraulic valve.
Figure 3:
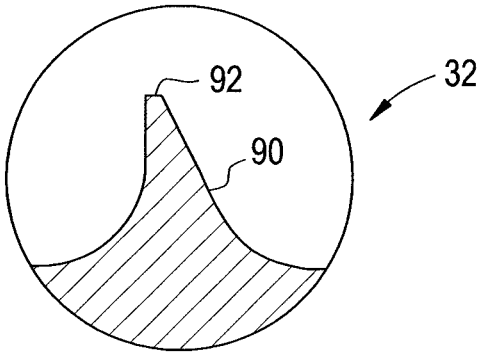
FIG. 3 shows an enlarged cross-sectional view of one of the lands of the spool.

FIG. 2 shows a preferred spool 22 and is self-explanatory, especially given the description hereinabove. Preferably, the lands 31, 32 are provided in the form of a shark fin type shape, as shown in FIG. 3 which provides an enlarged view of land 32. Functionally, it is important to have minimum travel of the lands 31, 32 in order to open the supply port P to either working port A or B. However, it is difficult to heat treat lands which are very thin. As such, a preferred spool provides lands which, for example, are 0.3 mm thick at their base, but taper on at least one side 90 such that they are only in the range of 0.1 mm to 0.3 mm thick at the surface 92 which actually, physically interfaces with the webs 33, 34 of the central bolt 27. As mentioned, FIG. 3 provides an enlarged view of land 32. An enlarged view of the other land 31 would look much similar, but would be a flipped image with the tapered surface 90 being on the opposite side.

It should be pointed out that one or more tapered land(s) (such as shark fin shape) can be provided on the spool 22, the bolt 27, or both. Additionally, the land(s) can be tapered on just one side or on both sides of the land.

Other benefits of providing thin lands is that it allows shorter spool travel. Additionally, it allows better timing characteristics for controlling the valve proportionally. This is because it allows the stroke devoted to positions 7*a* to 7*b* to be shortened, allowing for quicker transfer from on direction to the other.

With regard to FIGS. 4-10, some preferred sizes of overlaps (which prevents fluid from flowing) and openings (which allows fluid to flow) will now be described. Of course, other sizes of overlaps and openings can be used while staying fully within the scope of the present invention.

In FIG. 4, preferably there is an opening of 1.5 mm at the P to B1 location, preferably there is an opening of 1.5 mm at the B1 to B location, preferably there is an overlap of 3.0 mm at the B to T location, preferably there is an opening of 1.1 mm at the P to A1 location, preferably there is an overlap of 1.6 mm at the A1 to A location, and preferably there is an opening of 0.4 mm at the A to T location.

In FIG. 5, preferably there is an opening of 1.1 mm at the P to B1 location, preferably there is an opening of 1.1 mm at the B1 to B location, preferably there is an overlap of 2.6 mm at the B to T location, preferably there is an opening of 0.7 mm at the P to A1 location, preferably there is an overlap of 1.5 mm at the A1 to A location, and preferably there is an overlap of 0.0 mm at the A to T location.

In FIG. 6, preferably there is an opening of 0.4 mm at the P to B1 location, preferably there is an opening of 0.4 mm at the B1 to B location, preferably there is an overlap of 1.9 mm at the B to T location, preferably there is an opening of 0.0 mm at the P to A1 location, preferably there is an overlap of 0.8 mm at the A1 to A location, and preferably there is an overlap of 0.7 mm at the A to T location.

In FIG. 7, preferably there is an overlap of 0.2 mm at the P to B1 location, preferably there is an overlap of 0.2 mm at the B1 to B location, preferably there is an overlap of 1.3 mm at the B to T location, preferably there is an overlap of 0.2 mm at the P to A1 location, preferably there is an overlap of 0.2 mm at the A1 to A location, and preferably there is an overlap of 1.3 mm at the A to T location.

In FIG. 8, preferably there is an opening of 0.0 mm at the P to B1 location, preferably there is an overlap of 0.8 mm at the B1 to B location, preferably there is an overlap of 0.7 mm at the B to T location, preferably there is an opening of 0.4 mm at the P to A1 location, preferably there is an opening of 0.4 mm at the A1 to A location, and preferably there is an overlap of 1.9 mm at the A to T location.

In FIG. 9, preferably there is an opening of 0.7 mm at the P to B1 location, preferably there is an overlap of 1.5 mm at the B1 to B location, preferably there is an opening of 0.0 mm at the B to T location, preferably there is an opening of 1.1 mm at the P to A1 location, preferably there is an opening of 1.1 mm at the A1 to A location, and preferably there is an overlap of 2.6 mm at the A to T location.

In FIG. 10, preferably there is an opening of 1.1 mm at the P to B1 location, preferably there is an overlap of 1.6 mm at the B1 to B location, preferably there is an opening of 0.4 mm at the B to T location, preferably there is an opening of 1.5 mm at the P to A1 location, preferably there is an opening of 1.5 mm at the A1 to A location, and preferably there is an overlap of 3.0 mm at the A to T location.

The described embodiments only involve exemplary embodiments. A combination of the described features for the different embodiments is also possible. Additional features for the device parts belonging to the invention, particularly those which have not been described, can be derived from the geometries of the device parts shown in the drawings.

While specific embodiments of the invention have been shown and described, it is envisioned that those skilled in the art may devise various modifications without departing from the spirit and scope of the present invention. For example, the non-return valves can be designed as being ball or plate style non-return valves.

What is claimed is:

1. An oscillating-motor camshaft adjuster, having a hydraulic valve, the hydraulic valve comprising: two working ports, a supply port, and a tank port, wherein the hydraulic valve is configured to prevent one of the working ports from venting to the tank port, while the supply port pressurizes the other working port, wherein the two working ports comprise a first working port and a second working port, wherein the hydraulic valve is configured to provide seven states:

a first state during which the supply port pressurizes the first working port while the second working port allows recirculation into the first working port and simultaneously vents to the tank port;

a second state during which the supply port pressurizes the first working port while the second working port recirculates to the first working port, but does not vent to the tank port;

a third state during which the supply port pressurizes the first working port while the second working port is prevented from recirculating to the first working port, and is prevented from venting to the tank port;

a fourth state during which both the first and second working ports are prevented from being pressurized by the supply port, and are prevented from venting to the tank port;

a fifth state during which the supply port pressurizes the second working port while the first working port is prevented from recirculating to the second working port, and is prevented from venting to the tank port;

a sixth state during which the supply port pressurizes the second working port while the first working port recirculates to the second working port, but does not vent to the tank port; and a seventh state during which the supply port pressurizes the second working port while the first working port allows recirculation into the second working port and simultaneously vents to the tank port.

2. The oscillating-motor camshaft adjuster according to claim 1, wherein each working port has a standard opening and an additional opening for utilizing pressure peaks as a consequence of camshaft alternating torques.

3. The oscillating-motor camshaft adjuster according to claim 2, wherein each standard opening is configured to selectively vent to the tank port.

4. The oscillating-motor camshaft adjuster according to claim 1, wherein the hydraulic valve is configured to allow recirculation from the one working port to the other working port, while preventing the one working port from venting to the tank port, and while the supply port pressurizes the other working port.

5. The oscillating-motor camshaft adjuster according to claim 1, wherein the hydraulic valve is configured to prevent recirculation from the one working port to the other working port, while preventing the one working port from venting to the tank port, and while the supply port pressurizes the other working port.

6. The oscillating-motor camshaft adjuster according to claim 1, wherein the hydraulic valve comprises at least one of a spool and a bolt having at least one tapered land.

7. The oscillating-motor camshaft adjuster according to claim 1, wherein the hydraulic valve comprises at least one of a spool and a bolt having at least one land having a shark fin shape.

8. The oscillating-motor camshaft adjuster according to claim 1, wherein each working port has a standard opening and an additional opening for utilizing pressure peaks as a consequence of camshaft alternating torques, further comprising non-return valves on the additional opening of each working port.

9. The oscillating-motor camshaft adjuster according to claim 8, further comprising a non-return valve on the supply port.

10. The oscillating-motor camshaft adjuster according to claim 1, wherein the hydraulic valve is configured to, as the hydraulic valve moves from one portion to another position, increasingly allow flow from the supply port to the one working port, and increasingly allow recirculation from the other working port into the one working port.

11. The oscillating-motor camshaft adjuster according to claim 1, wherein the hydraulic valve is configured to, as the hydraulic valve moves from a first portion to a second position, increasingly allow flow from the supply port to the first working port, and increasingly allow recirculation from the second working port into the first working port.

12. The oscillating-motor camshaft adjuster according to claim 1, wherein the hydraulic valve is configured to, as the hydraulic valve moves from one portion to another position, increasingly allow flow from the one working port to the tank port, and increasingly allow recirculation of the one working port to the other working port.

13. An oscillating-motor camshaft adjuster, having a hydraulic valve, the hydraulic valve comprising: two working ports, a supply port, and a tank port, wherein the hydraulic valve is configured to prevent one of the working ports from venting to the tank port, while the supply port pressurizes the other working port, wherein the hydraulic valve comprises at least one of a spool and a bolt having at least one land having a shark fin shape.

* * * * *